US010655820B2

(12) United States Patent
Nobis et al.

(10) Patent No.: US 10,655,820 B2
(45) Date of Patent: May 19, 2020

(54) ROTATIONALLY ADJUSTABLE WALL WASH LUMINAIRE

(71) Applicant: Eaton Intelligent Power Limited, Dublin (IE)

(72) Inventors: Joshua B. Nobis, Cave Creek, AZ (US); Grzegorz Wronski, Peachtree City, GA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/125,304

(22) Filed: Sep. 7, 2018

(65) Prior Publication Data

US 2020/0080706 A1 Mar. 12, 2020

(51) Int. Cl.

| | |
|---|---|
| ***F21V 14/04*** | (2006.01) |
| ***F21V 17/02*** | (2006.01) |
| ***F21V 7/00*** | (2006.01) |
| ***F21S 8/02*** | (2006.01) |

(52) U.S. Cl.

CPC ..... *F21V 14/04* (2013.01); *F21S 8/026* (2013.01); *F21V 7/0025* (2013.01); *F21V 17/02* (2013.01)

(58) Field of Classification Search

CPC ..... F21V 14/04; F21V 7/0025; F21V 17/02; F21V 14/045; F21V 14/00; F21V 21/02; F21V 21/03; F21V 21/04; F21V 7/00; F21S 8/026; F21S 8/02; F21S 8/024

See application file for complete search history.

(56) References Cited

U.S. PATENT DOCUMENTS

| | | | | |
|---|---|---|---|---|
| 4,475,147 | A * | 10/1984 | Kristofek | F21S 8/026 362/147 |
| 5,562,343 | A * | 10/1996 | Chan | F21S 8/02 362/147 |
| 6,554,457 | B1 * | 4/2003 | Platt | F21V 19/04 362/269 |
| 6,632,006 | B1 * | 10/2003 | Rippel | F21S 8/02 362/147 |
| 9,052,081 | B1 * | 6/2015 | Paulsel | F21V 17/002 |
| 9,234,640 | B2 * | 1/2016 | Geralds | F21S 8/026 |
| 10,006,605 | B2 * | 6/2018 | Zhang | F21S 8/026 |
| 2013/0286646 | A1 * | 10/2013 | Snell | F21V 13/04 362/231 |

* cited by examiner

*Primary Examiner* — Bao Q Truong
(74) *Attorney, Agent, or Firm* — King & Spalding LLP

(57) ABSTRACT

A wall wash luminaire includes a trim assembly that has a trim and a light re-direction assembly. The light re-direction assembly includes a reflector kicker that is configured to re-direct light from the wall wash luminaire and an optical lens that is coupled to the reflector kicker such that the reflector kicker and the optical lens operate as a single unit. The light re-direction assembly is removably coupled to the trim such that the light re-direction assembly is slidingly rotatable with respect to the trim and 360 degrees about a central axis of the trim assembly.

16 Claims, 12 Drawing Sheets

ROTATIONALLY ADJUSTABLE WALL WASH LUMINAIRE

TECHNICAL FIELD

Embodiments of the present disclosure relate generally to luminaires, and more particularly to a rotationally adjustable wall wash luminaire.

BACKGROUND

Wall wash luminaires are lighting devices that are configured to illuminate a vertical wall while being mounted onto a mounting surface other than the vertical wall, such as a ceiling, floor, etc. As illustrated in FIG. 1, a conventional wall wash luminaire 100 includes a light fixture 104 that is recess mounted in a mounting surface, such as a ceiling, via a plaster ring 102 that may be disposed in the mounting surface. The light fixture 104 of the conventional wall wash luminaire 100 includes a light module 111 and a heat sink module 112 that are coupled to a trim assembly 103. The light fixture 104 is coupled to the plaster ring 102 by engaging the torsion springs (114*a*, 114*b*) of the light fixture 104 with corresponding torsion spring receivers (202*a*, 202*b*) (shown in FIG. 2) in the plaster ring 102. Further, the light fixture 104 of the conventional wall wash luminaire 100 includes a reflector kicker 110 that is fastened to a trim 108 of the trim assembly 103 to re-direct a uniform distribution of light emitted from a light source of the wall wash luminaire 100 onto a vertical wall 106. If the light emitted from the wall wash luminaire 100 is to be directed in a different direction other than the vertical wall 106 (e.g., to an opposite vertical wall), then, the light fixture 104 has to be uninstalled from the plaster ring 102, rotated, and reinstalled in the plaster ring 102. The uninstallation and reinstallation of the light fixture 104 to change a direction of the light from the wall wash luminaire 100 may be inconvenient and labor intensive.

Further, the position and arrangement of the torsion spring receivers (202*a*, 202*b*) in the plaster ring 102 (as illustrated in FIG. 2) limits the adjustment of the light fixture 104 to two positions, which in turn limits the direction in which the light from the wall wash luminaire 100 can be directed to two directions. For example, in a first position where a first torsion spring 114*a* of the light fixture 104 engages the first torsion spring receiver 202*a* and a second torsion spring 114*b* of the light fixture 104 engages the second torsion spring receiver 202*b*, the light emitted from the wall wash luminaire 100 is re-directed by the reflector kicker 110 to the vertical wall 106; and in a second position where the first torsion spring 114*a* of the light fixture 104 engages the second torsion spring receiver 202*b* and the second torsion spring 114*b* of the light fixture 104 engages the first torsion spring receiver 202*a*, the light emitted from the wall wash luminaire 100 is re-directed by the reflector kicker 110 to a vertical wall 204 that is 180° opposite to the vertical wall 106. That is, even if the requirement to uninstall and re-install the light fixture 104 of the wall wash luminaire 100 in the plaster ring 102 to change a direction of the light emitted therefrom is overlooked, the conventional wall wash luminaire 100 only allows the light emitted therefrom to be directed in one of two directions that are 180° opposite to each other.

If the light emitted from the conventional wall wash luminaire 100 is to be re-directed to any other direction other than the direction of the vertical walls 106 and 204 that are 180° opposite to each other, e.g., direction A or direction B (shown in FIG. 2), the plaster ring 102 has to be uninstalled from the ceiling joists, rotated, and re-installed, which may be impractical, laborious, and inconvenient. Additionally, uninstalling and reinstalling the plaster ring 102 from the ceiling may require opening up the ceiling which may greatly increase the labor cost.

This background information is provided to reveal information believed to be of possible relevance to the present disclosure. No admission is necessarily intended, nor should be construed, that any of the preceding information constitutes prior art against the present disclosure.

SUMMARY

In one aspect, the present disclosure relates to a wall wash luminaire that includes a trim assembly. The trim assembly includes a trim, and a light re-direction assembly. The light re-direction assembly includes a reflector kicker, and an optical lens that is coupled to the reflector kicker. The light re-direction assembly is coupled to the trim such that the light re-direction assembly is slidingly rotatable with respect to the trim and about a central axis of the trim assembly.

In another aspect, the present disclosure relates to a wall wash luminaire that includes a light re-direction assembly. The light re-direction assembly includes a reflector kicker, and an optical lens that is coupled to the reflector kicker. The light re-direction assembly is configured to be coupled to a trim of the wall wash luminaire such that the light re-direction assembly is slidingly rotatable with respect to the trim and about a central axis of the trim.

These and other aspect, objects, features, and embodiments, will be apparent from the following description and the appended claims.

BRIEF DESCRIPTION OF THE FIGURES

The foregoing and other features and aspects of the present disclosure are best understood with reference to the following description of certain example embodiments, when read in conjunction with the accompanying drawings, wherein.

Figure 1:
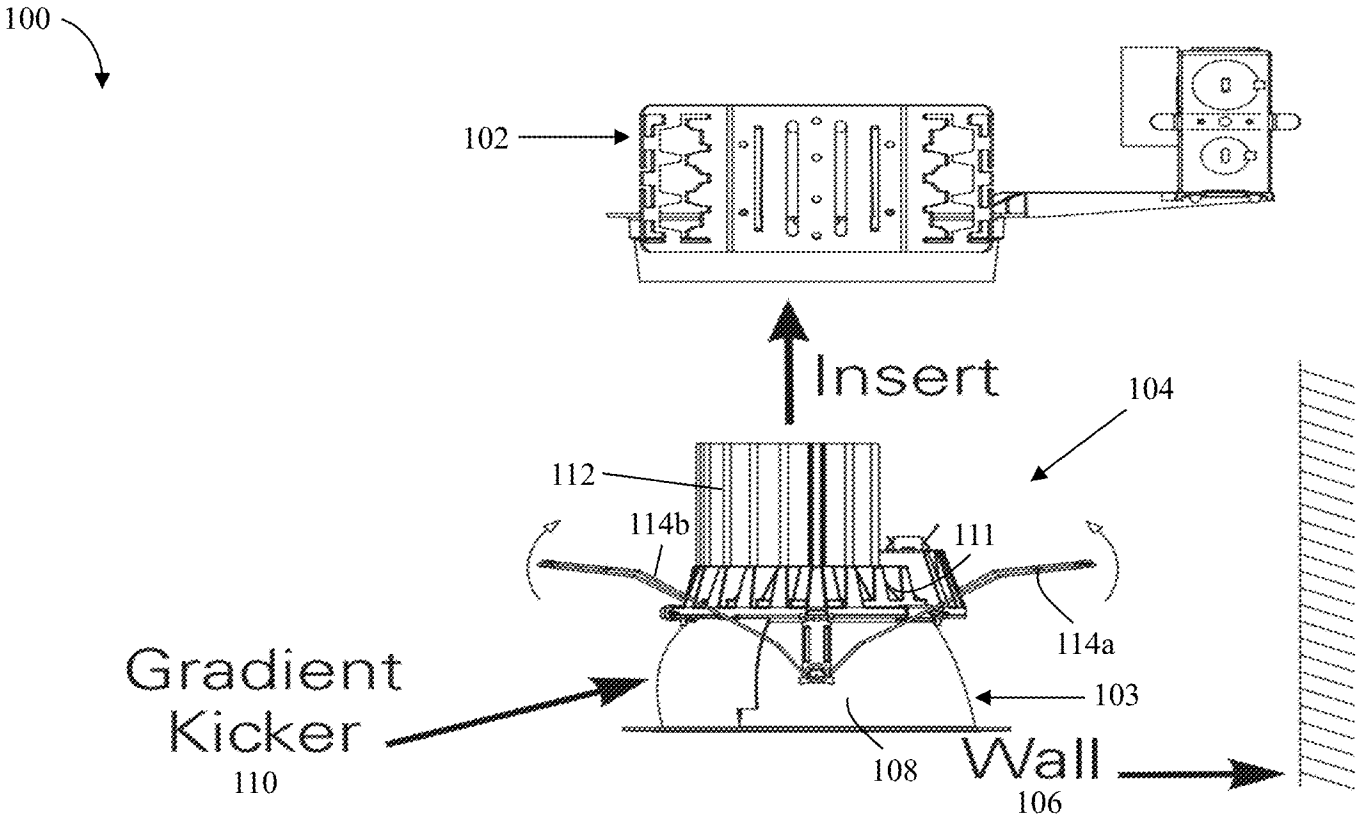
(Prior Art) FIG. 1
FIG. 1 illustrates a conventional wall wash luminaire where a reflector kicker is fastened to a trim of the wall wash luminaire, in accordance with a prior art luminaire.
Figure 2:
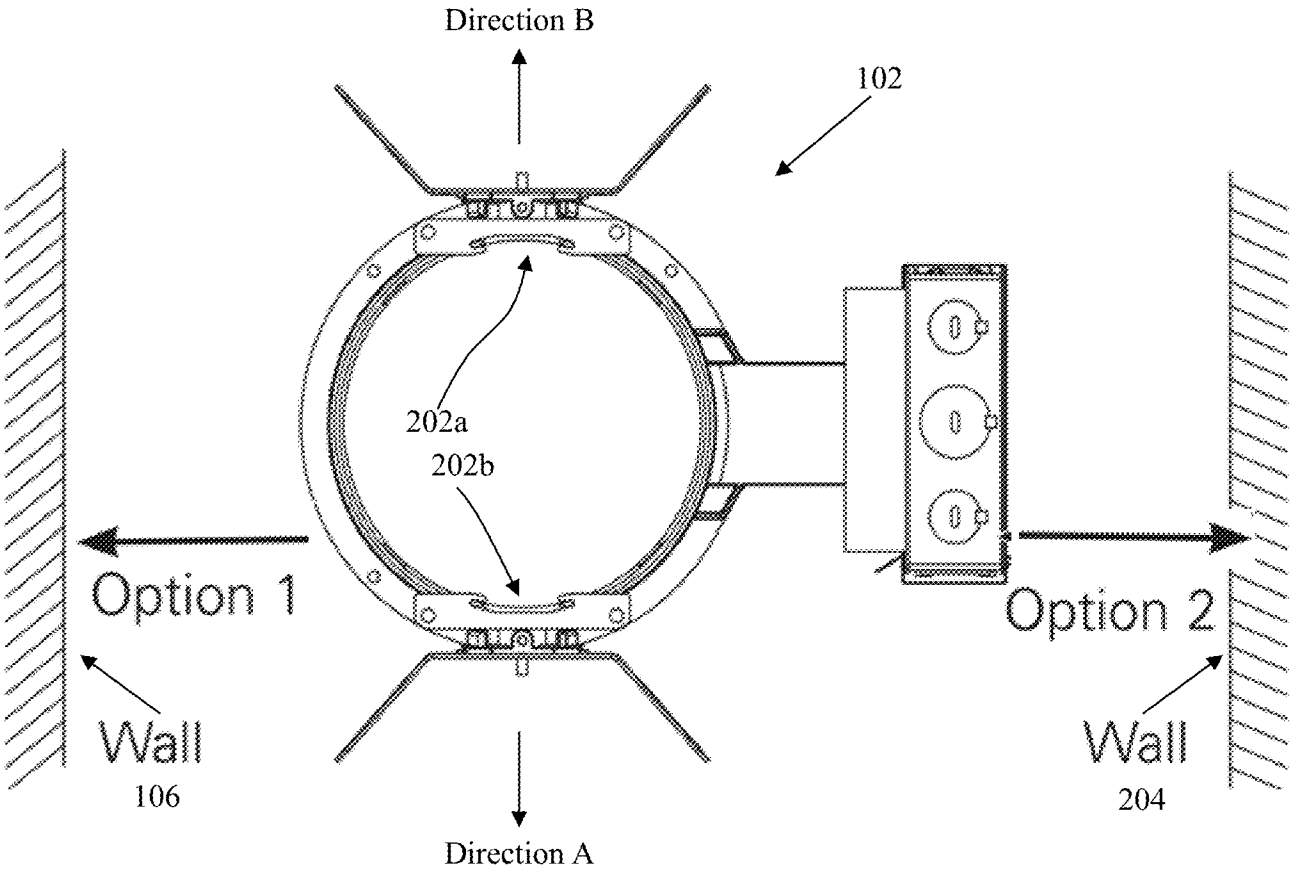
FIG. 2 illustrates a top view of the plaster ring of FIG. 1, in accordance with a prior art luminaire.

The drawings illustrate only example embodiments of the present disclosure and are therefore not to be considered limiting of its scope, as the present disclosure may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles.

DETAILED DESCRIPTION OF EXAMPLE EMBODIMENTS

In the following paragraphs, a rotationally adjustable wall wash luminaire (hereinafter 'wall wash luminaire') will be described in further detail by way of examples with reference to the attached drawings. In the description, well-known components, methods, and/or processing techniques are omitted or are briefly described so as not to obscure the disclosure. As used herein, the "present disclosure" refers to any one of the embodiments of the disclosure described herein and any equivalents. Furthermore, reference to various feature(s) of the "present disclosure" is not to suggest that all embodiments must include the referenced feature(s).

The wall wash luminaire of the present disclosure is configured to be rotationally adjustable such that light emitted therefrom can be directed to any appropriate direction that is within 360° around the wall wash luminaire and thereby illuminate any appropriate vertical wall surface adjacent the wall wash luminaire. Further, unlike conventional wall wash luminaires, the wall wash luminaire of the present disclosure is rotationally adjustable while the light fixture and/or the trim assembly of the wall wash luminaire remains installed in the plaster ring or ceiling. That is, unlike conventional wall wash luminaires, changing a direction of the light emitted from the wall wash luminaire of the present disclosure does not require the light fixture and/or the trim assembly of the wall wash luminaire to be uninstalled from the plaster ring, adjusted, and re-installed.

The example wall wash luminaire of the present disclosure includes a trim assembly that is configured to be removably coupled to a plaster ring disposed in the ceiling for a recessed installation of the wall wash luminaire. In other examples, the wall wash luminaire may be surface mounted or mounted to a floor surface as uplight to light a vertical wall surface without departing from a broader scope of the present disclosure. The trim assembly of the example wall wash luminaire includes a trim and a light re-direction assembly (interchangeably referred to as a "wall wash kicker assembly") that is coupled to the trim such that the light re-direction assembly can be slidingly rotated about a central axis of the wall wash luminaire to direct light emitted from the wall wash luminaire to any appropriate wall surface that is adjacent to and within 360° around the wall wash luminaire. The term 'slidingly rotatable' or 'slidingly rotated' as used herein generally refers to the ability to rotate the light re-direction assembly or a component thereof about an axis without disassembling the luminaire.

The light re-direction assembly of the example wall wash luminaire may include a reflector kicker and an optical lens that is coupled to the reflector kicker such that they operate as a single unit. The reflector kicker may include tabs that are formed therein and configured to engage the trim to removably couple the light re-direction assembly to the trim. In one example, the optical lens may be ultrasonically welded to the reflector kicker, however, in other examples, the optical lens and the reflector kicker can be coupled to each other using any other appropriate coupling mechanism without departing from a broader scope of the present disclosure.

Figure 3:
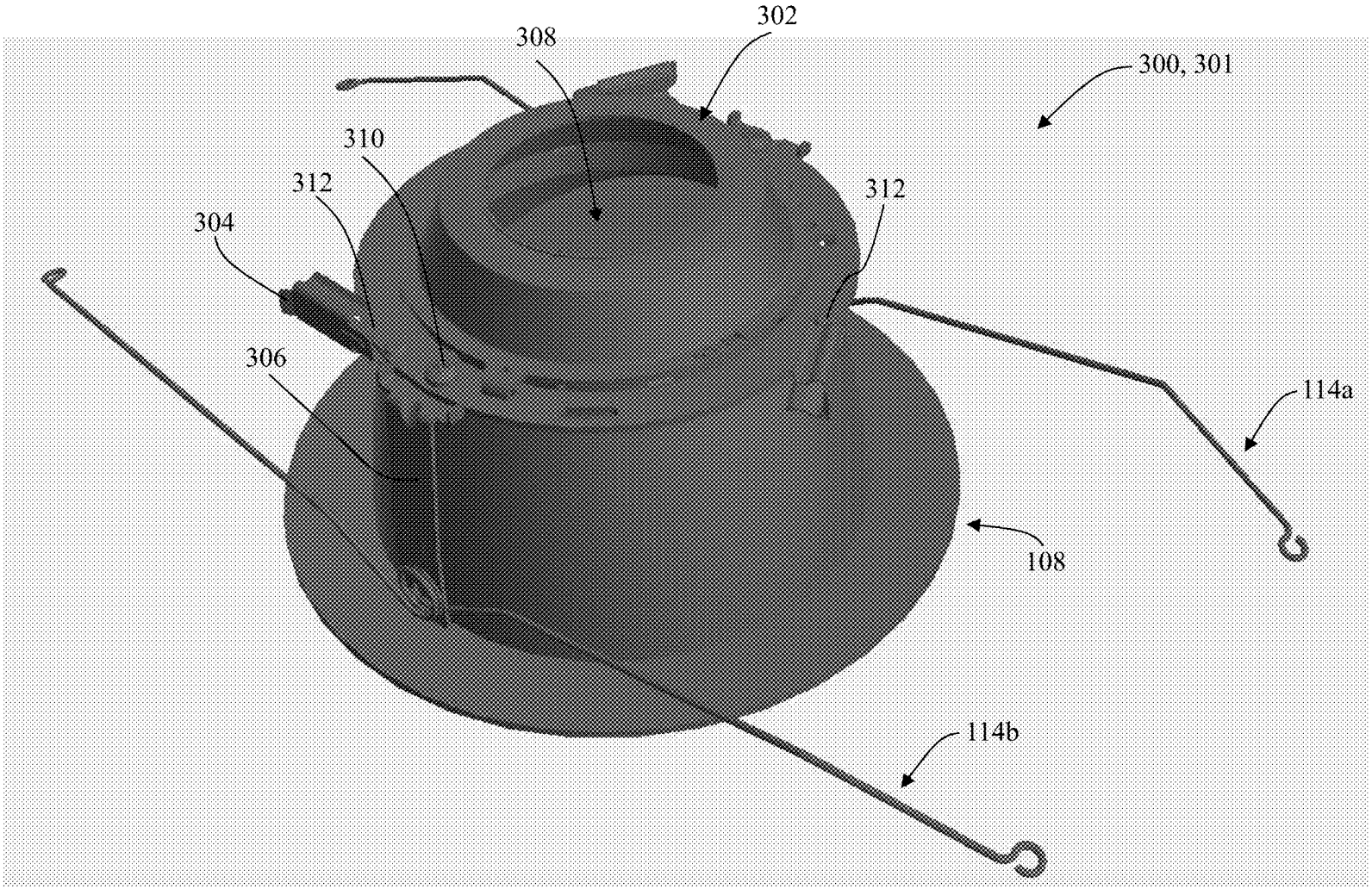
FIG. 3 illustrates a perspective view of a light fixture of a rotationally adjustable wall wash luminaire, in accordance with example embodiments of the present disclosure.

Moving now to discuss the figures, FIGS. 3-11 illustrate an example embodiment of the wall wash luminaire 300 that is rotationally adjustable. Referring to FIG. 3, an example wall wash luminaire 300 may include a trim assembly 301 that has a trim 108 (also interchangeably referred to as "bottom reflector"), a top reflector 302 that is coupled to the trim 108, and a light re-direction assembly 308 that is coupled to trim 108 such that the light re-direction assembly 308 is slidingly rotatable about a central axis 901 (shown in FIGS. 9 and 10) of the trim assembly 301 of the wall wash luminaire 300. Although not shown in FIGS. 3-11, in addition to the trim assembly 301, the wall wash luminaire 300 may include a heat sink assembly, i.e., the heat sink 112 and the light module 111 (shown in FIG. 1) that are removably coupled to the trim assembly 301. Further, the wall wash luminaire 300 may include one or more torsion springs (114*a* and 114*b*) that may be configured to couple the wall wash luminaire 300 to the plaster ring 102. For example, the legs of each torsion spring 114*a* and 114*b* may be pinched together to produce a biasing effect which, once coupled within torsion spring receivers 202*a* and 202*b* of the plaster ring 102, facilitates coupling of the wall wash luminaire 300 with the plaster ring 102.

The torsion springs (114*a* and 114*b*) may be coupled to the trim 108 via torsion spring brackets 306. In one or more example embodiments, the torsion spring brackets 306 may be coupled to the trim 108 via fasteners 310 or any other appropriate coupling mechanisms without departing from a broader scope of the present disclosure. Furthermore, the wall wash luminaire 300 may include coupling clips 304 that are configured to couple and securely retain a heat sink assembly (111 and 112) (shown in FIG. 1) to the trim assembly 301 of the wall wash luminaire 300. The coupling clips 304 may be coupled to the trim 108 using fasteners, such as rivets 312, or any other appropriate coupling mechanisms without departing from a broader scope of the present disclosure.

Figure 4:
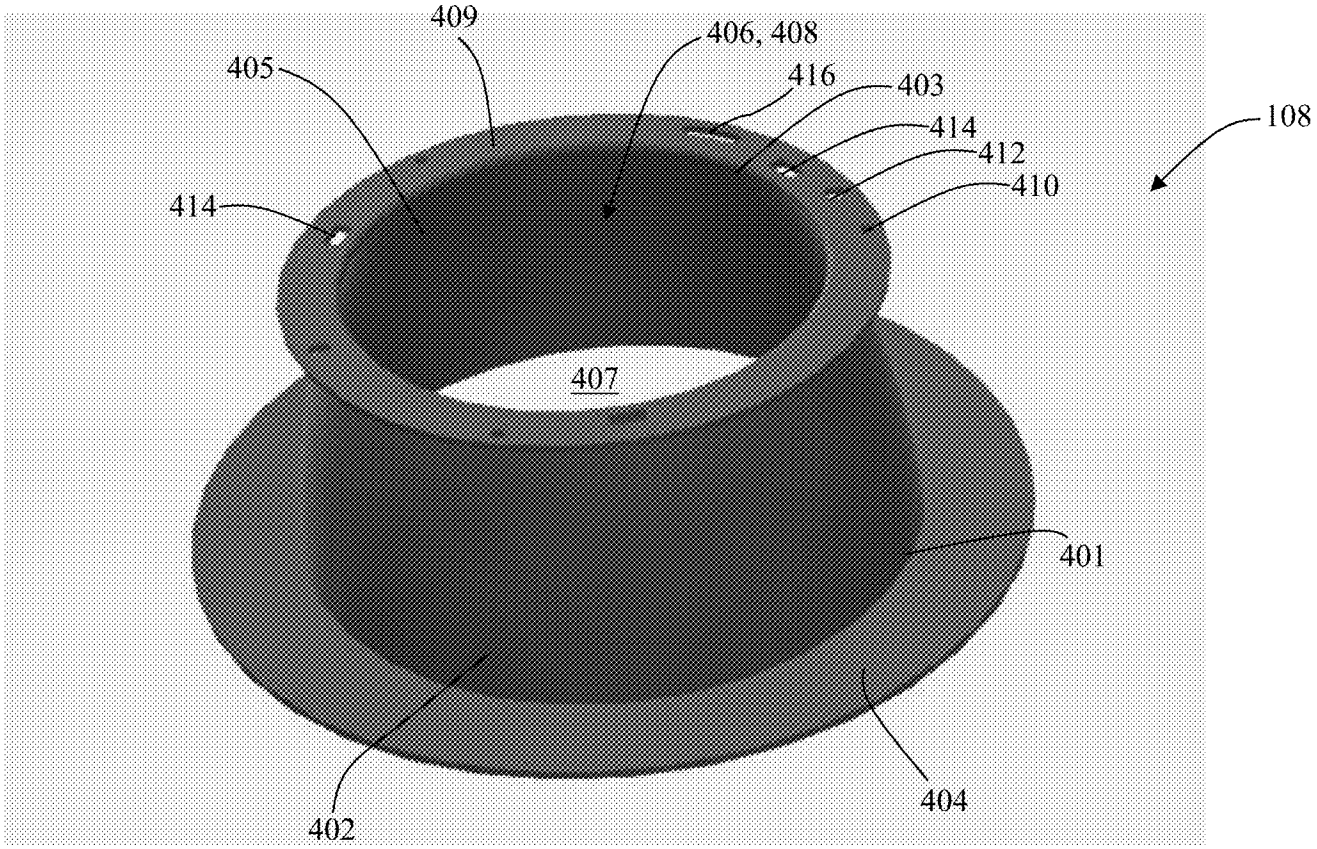
FIG. 4 illustrates a perspective view of a trim of the rotationally adjustable wall wash luminaire of FIG. 3, in accordance with example embodiments of the present disclosure.

Turning to FIG. 4, the trim 108 of the trim assembly 301 may include a first body 402 that extends and tapers from a first bottom annular edge 401 that defines a light exit opening 407 to a first top annular edge 403 that defines a light receiving opening 406. In some example embodiments, the first body 402 of the trim 108 may not taper from the first bottom annular edge 401 to the first top annular edge 403. The first body 402 may define an inner cavity 408 that extends therethrough from the light receiving opening 406 through the light exit opening 407. An inner surface 405 of the first body 402 may be coated using reflective paint coating to direct light emitted from a light source (not shown) of the wall wash luminaire 300 and entering the inner cavity 408 of the trim 108 towards an area to be illuminated via the light exit opening 407 of the trim 108. Alternatively, in other example embodiments, any other appropriate reflective mechanisms may be used. For example, the trim 108 may be formed using reflective material.

Further, the trim 108 may include a first bottom flange 404 that extends substantially horizontally and radially outward from the first bottom annular edge 401. Furthermore, the trim 108 may include a first top flange 409 that extends substantially horizontally and radially outward from the first top annular edge 403. In one example embodiment, the first bottom flange 404 may be wider than the first top flange 409 as illustrated in FIGS. 3, 4, 9, 10, and 11. However, in other example embodiments, the first top flange 409 may be wider than the first bottom flange 404 or they may be of the substantially same width without departing from a broader scope of the present disclosure. Furthermore, one of skill in the art can understand and appreciate that in other example embodiments, the first bottom flange 404 may have any other shape without departing from a broader scope of the present disclosure.

Figure 12:
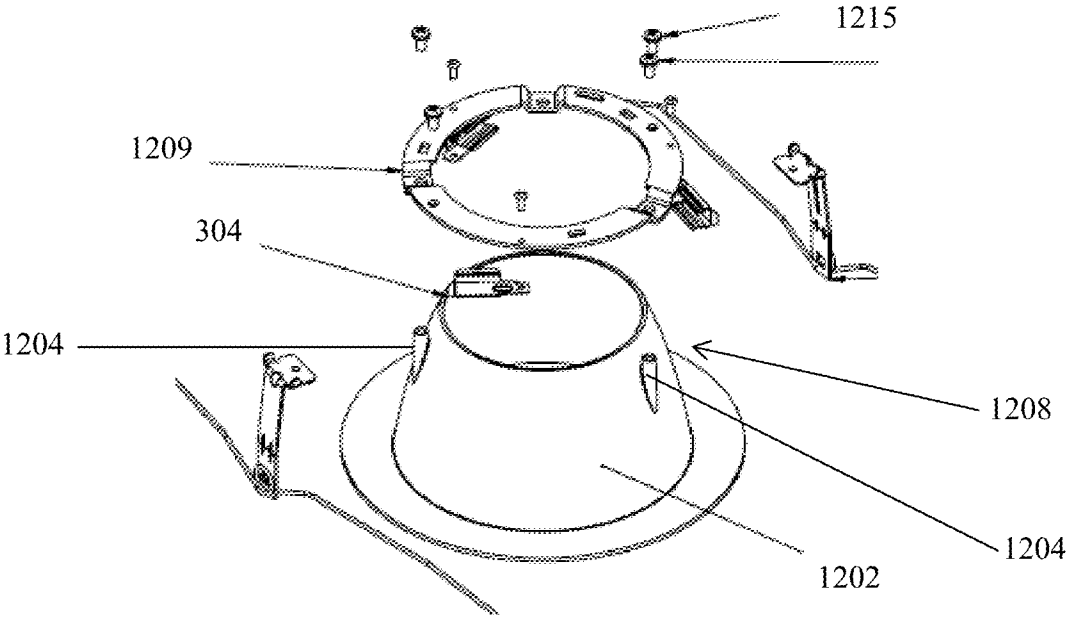
FIG. 12 illustrated an example embodiment where a top flange is separate from and coupled to the trim of the light fixture, in accordance with example embodiments of the present disclosure.

Additionally, in some example embodiments, the first top flange 409 may not be integral with the trim 108. Instead, the first top flange 409 may be separate from the trim 108 and may be coupled to the trim 108 as illustrated in FIG. 12. For example, a plastic trim 1208 may include coupling bosses 1204 formed on the body 1202 of the trim 1208 for receiving fasteners 1215 therethrough to removably couple a top flange 1209 to the trim 1208, where the top flange 1209 may be separate from (i.e., not integrally formed with) the trim 1208.

As illustrated in FIG. 4, the first top flange 409 may include coupling slots 414 that are configured to receive corresponding reflector tabs 512 (shown in FIG. 5) of the top reflector 302 therethrough to couple the top reflector 302 to the trim 108. Further, the first top flange 409 may include an alignment slot 416 that is configured to receive an alignment tab (not shown) of the heat sink assembly (111 and 112) for easy alignment of the heat sink assembly (111 and 112) on the trim 108. Furthermore, the first top flange 409 of the trim 108 may include one or more coupling holes (410, 412) that are configured to receive fasteners (310, 312) therethrough to removably couple the coupling clips 304 and the torsion spring bracket 306 to the trim 108 as illustrated in FIG. 3.

Figure 5:
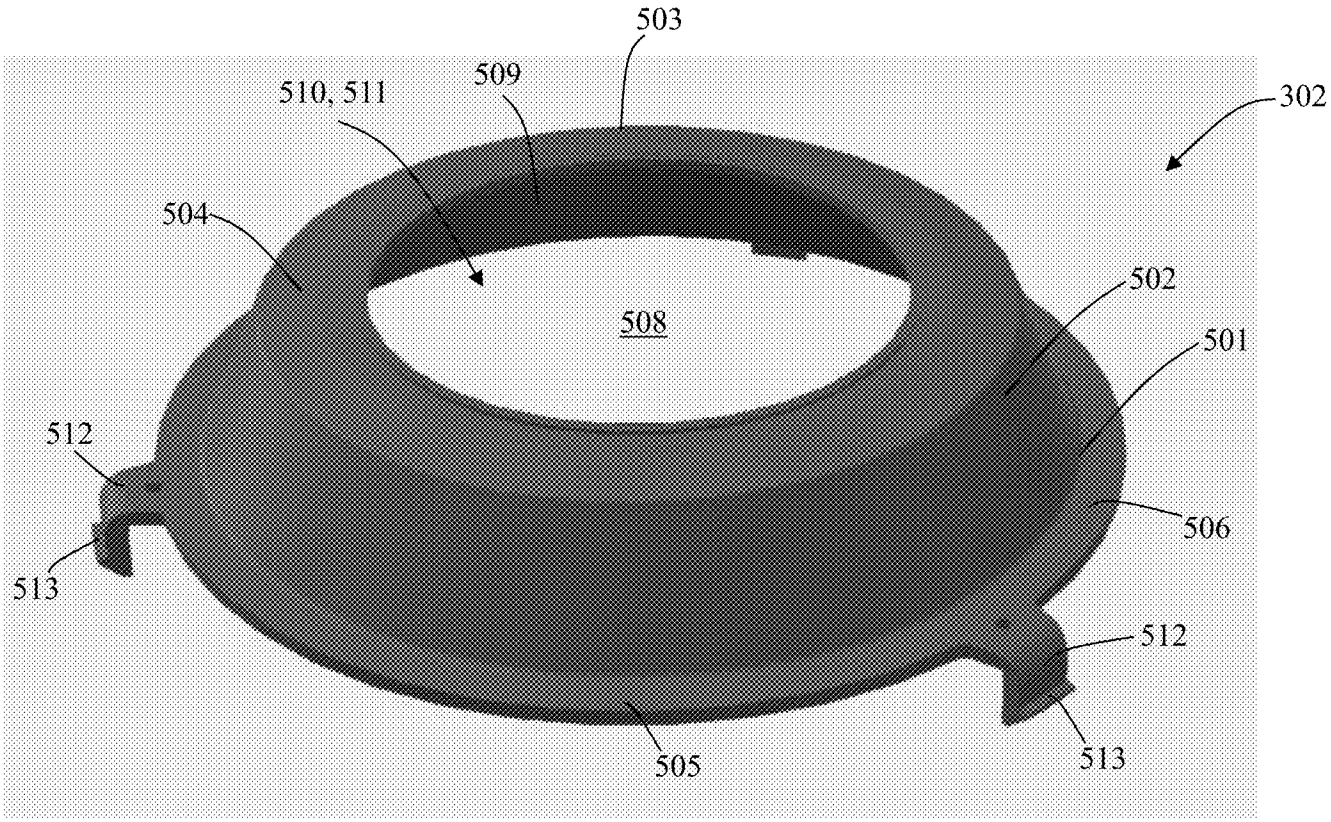
FIG. 5 illustrates a perspective view of a top reflector of the rotationally adjustable wall wash luminaire of FIG. 3, in accordance with example embodiments of the present disclosure.

Turning to FIG. 5, the top reflector 302 of the trim assembly 301 may include a second body 502 that extends and tapers from a second bottom annular edge 501 that defines a bottom opening 508 to a second top annular edge 503. An inner surface 509 of the second body 502 of the top reflector 302 may be made reflective using any appropriate reflective coating or alternatively, the top reflector 302 may be formed using reflective material. The second body 502 of the top reflector 502 may define a reflector inner cavity 510 that extends from a top opening 511 defined by a second top flange 504 of the top reflector 302 through the bottom opening 508. The second top flange 504 may extend radially inward from the second top annular edge 503 towards the reflector inner cavity 510. Further, the top reflector 302 may include a second bottom flange 506 that extends radially outward from the second bottom annular edge 501. Furthermore, the top reflector 302 may include reflector tabs 512 that extend out from an outer edge 505 of the second bottom flange 506. As illustrated in FIG. 5, in one example embodiment, the reflector tabs 512 may be extending downwards from the second bottom flange 506 of the top reflector 302 and may be substantially L-shaped with hook shaped ends 513. However, in other example embodiments, the reflector tabs 512 can have any other appropriate shape that can engage with corresponding coupling slots 414 of the trim 108 to removably couple and securely retain the top reflector 302 to the trim 108.

Even though the present disclosure describes the body 502 of the top reflector 302 as being tapered from the second bottom annular edge 501 towards the second top annular edge 503, one of skill in the art can understand and appreciate that in other example embodiments, the top reflector 302 and the body 502 of the top reflector 302 can have any other appropriate shape without departing from a broader scope of the present disclosure.

Figure 6:
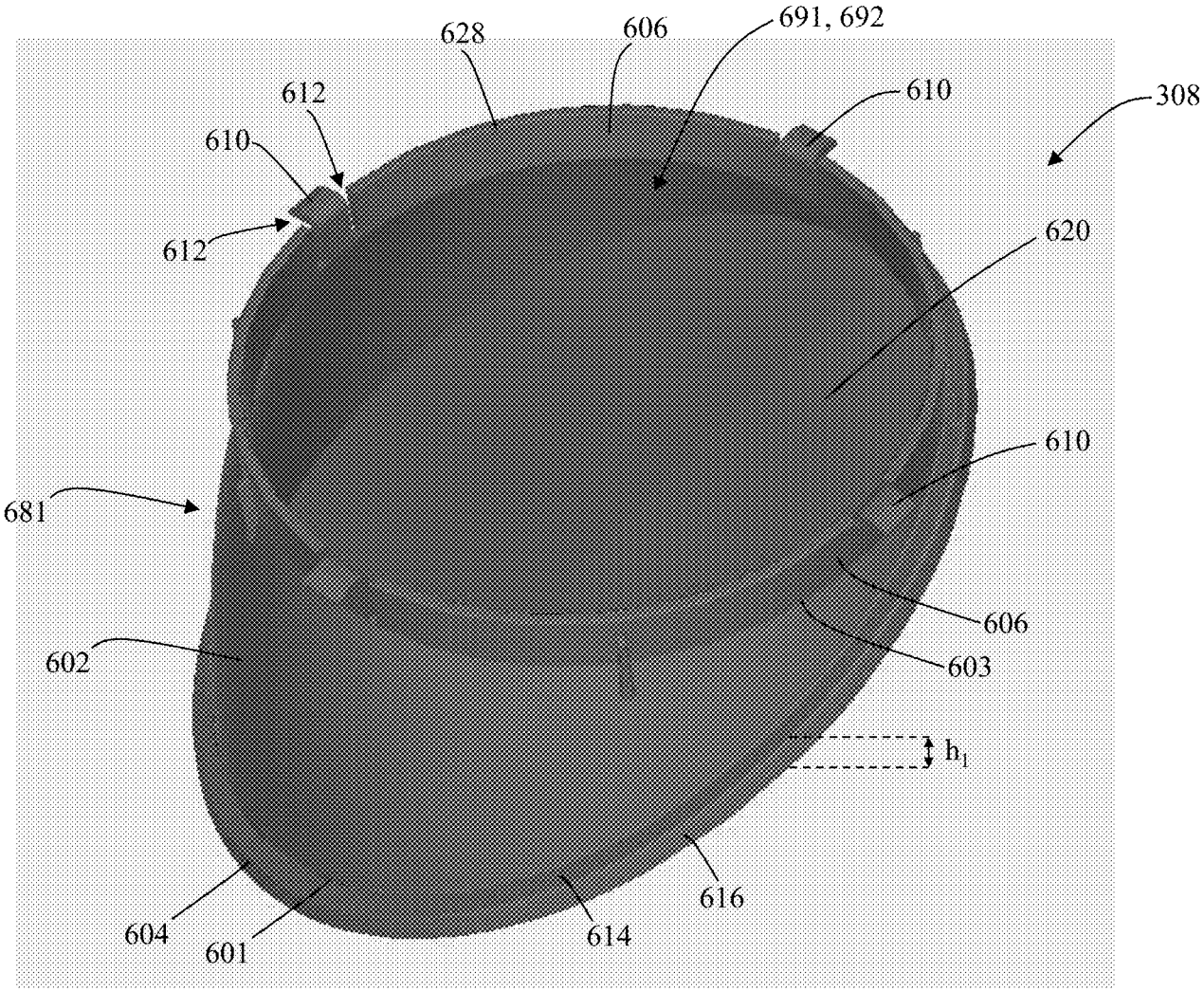
FIG. 6 illustrates a top perspective view of a light re-direction assembly of the rotationally adjustable wall wash luminaire of FIG. 3, in accordance with example embodiments of the present disclosure.
Figure 7:
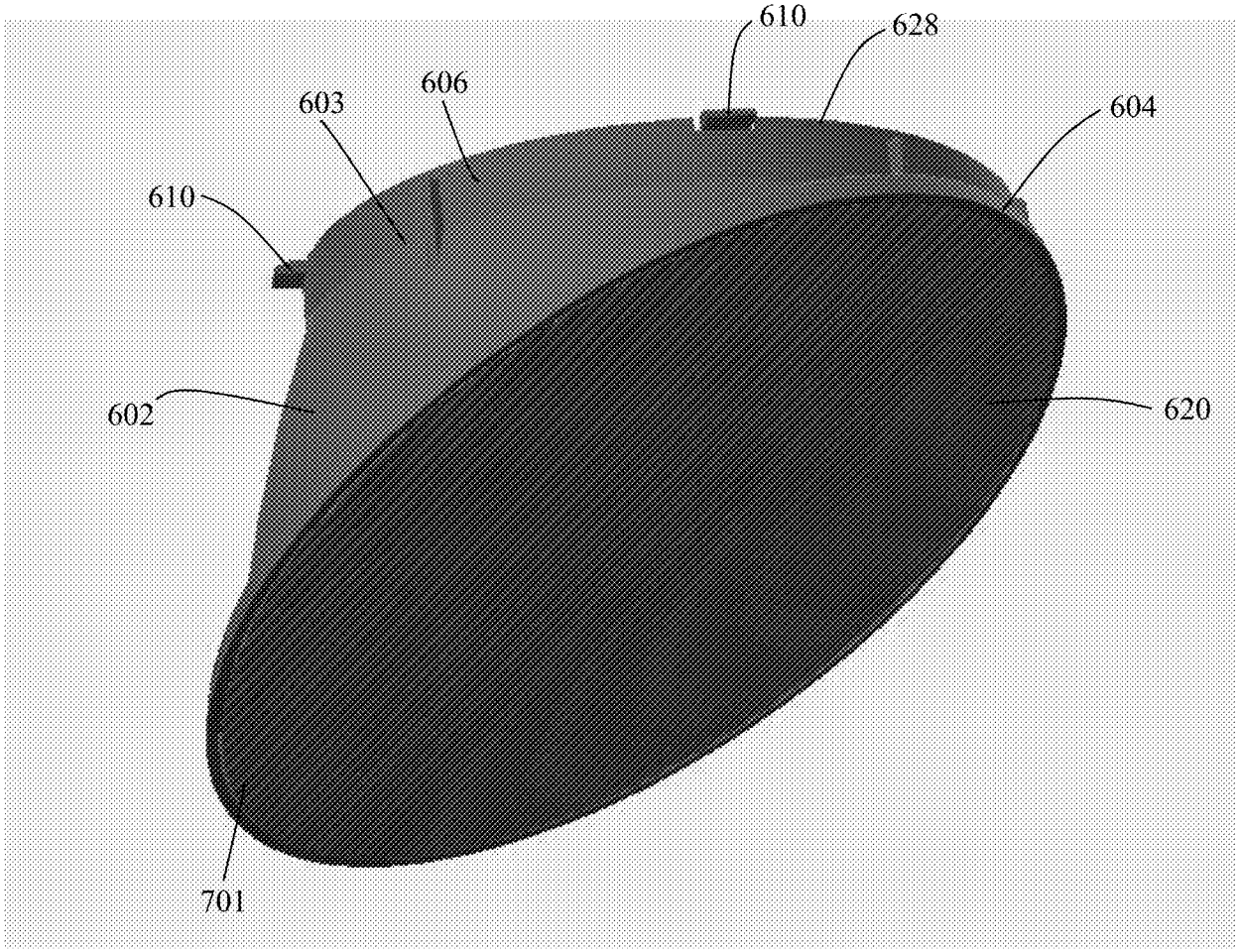
FIG. 7 illustrates a bottom perspective view of the light re-direction assembly of the rotationally adjustable wall wash luminaire of FIG. 3, in accordance with example embodiments of the present disclosure.
Figure 8:
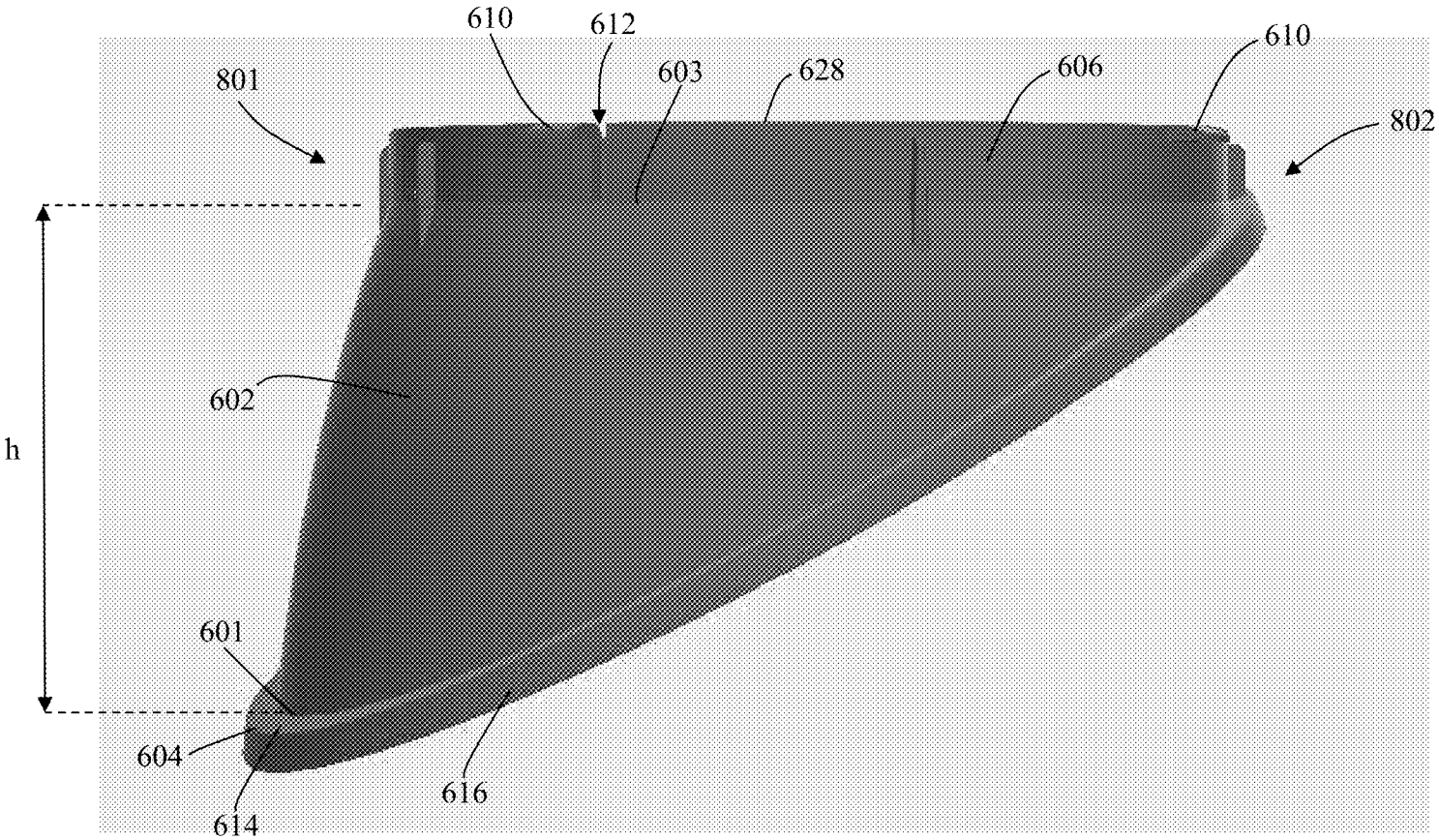
FIG. 8 illustrates a side view of light re-direction assembly of the rotationally adjustable wall wash luminaire of FIG. 3, in accordance with example embodiments of the present disclosure.

Turning to FIGS. 6-8, the light re-direction assembly 308 of the trim assembly 301 may include a reflector kicker 681 and an optical lens 620 that is coupled to the reflector kicker 681. In particular, the reflector kicker 681 may include a third body 602 that extends from a third top annular edge 603 that defines a top aperture 691 to a third bottom annular edge 601 that defines a bottom aperture (covered by the optical lens 620). The third body 602 defines an internal cavity 692. Further, the height 'h' of the third body 602 of the reflector kicker 681 (measured from the third top annular edge 603 to the third bottom annular edge 601 as shown in FIG. 8) tapers from a first side 801 of the reflector kicker 681 to an opposite second side 802 of the reflector kicker 681 (shown in FIG. 8). Furthermore, the inner surface 911 (shown in FIG. 9) of the body 602 of the reflector kicker 681 may be concave shaped or curved from the third top annular edge 603 towards the third bottom annular edge 601.

In addition to the third body 602, the reflector kicker 681 may include a top collar 606 that extends upwards from the third top annular edge 603 towards a collar outer edge 628. Further, the reflector kicker 681 may include coupling tabs 610 that extend radially and substantially outward from the collar outer edge 628. For example, as illustrated in FIGS. 6-8, the reflector kicker 681 may include four coupling tabs 610: two located adjacent the first side 801 of the reflector kicker 681 and two located adjacent the opposite second side 802 of the reflector kicker 681. Furthermore, the top collar 606 may have relief cuts 612 that are formed therein. The relief cuts 612 may be formed adjacent to and on opposite sides of the coupling tabs 610, e.g., coupling tabs 610 disposed adjacent the first side 801 of the reflector kicker 681. Some coupling tabs 610, such as the coupling tabs 610 disposed adjacent the opposite second side 802 of the reflector kicker 681, may not have relief cuts formed in the top collar 606 on opposite sides of the coupling tabs 610 to prevent any light leakage therethrough. The relief cuts 612 may provide flexibility to the coupling tabs 610 for coupling to the trim 108. In other example embodiments, the reflector kicker 681 may not include any relief cuts 612 formed in the top collar 606 and associated with the coupling tabs 610. Instead, the coupling tabs 610 may be made flexible using any other appropriate mechanism without departing from a broader scope of the present disclosure.

The reflector kicker 681 may further include a bottom coupling flange 604 that extends radially outward from the third bottom annular edge 601 of the reflector kicker 681. The bottom coupling flange 604 may be substantially L-shaped and may define an inner opening. The bottom flange may include a first leg 614 that extends radially outward from the third bottom annular edge 601 and a second leg 616 that extends downwards and substantially perpendicular to the first leg 614 from an outer edge of the first leg 614. The height 'hi' of the second leg 616 may be determined based on the thickness 't' of the optical lens 620 that is coupled to the reflector kicker 681. In other words, the height 'hi' of the second leg 616 of the bottom coupling flange 604 may be such that the optical lens 620 coupled to the reflector kicker 681 may be flush with the bottom surface 701 of the reflector kicker 681. The first leg 614 of the bottom coupling flange 604 may define a shoulder on or against which the optical lens 620 can rest. Further, the first leg may operate as a stop feature that prevents the optical lens 620 from being inserted further into the reflector kicker 681. The optical lens 620 may include any appropriate lens that is configured to diffuse and/or change a distribution pattern of the light exiting the wall wash luminaire 300 through the optical lens 620 to an area to be illuminated.

Figure 9:
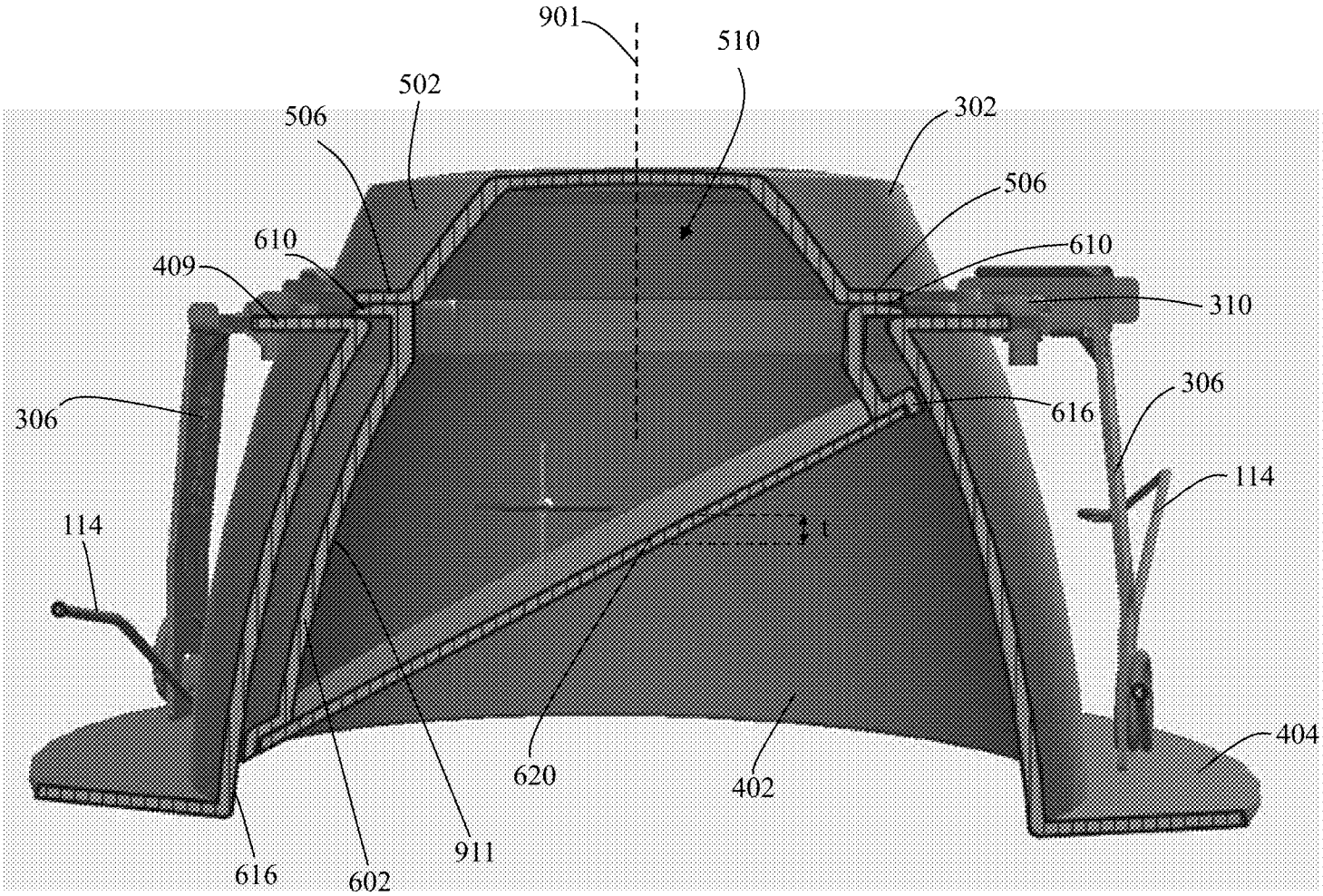
FIG. 9 illustrates a cross sectional view of the rotationally adjustable wall wash luminaire of FIG. 3 along the X-X' axis, in accordance with example embodiments of the present disclosure.

In one example embodiment, the optical lens 620 may be fixedly coupled to and disposed in the inner opening defined by the bottom coupling flange 604 of the reflector kicker as illustrated in FIG. 9, using any appropriate coupling mechanism such that the reflector kicker 681 and the optical lens 620 operate as a single unit. For example, the optical lens 620 may be ultrasonically welded to the reflector kicker 681. In other example embodiments, the optical lens 620 may be removably coupled to and disposed in the inner opening defined by the reflector kicker 681 without departing from a broader scope of the present disclosure.

Figure 10:
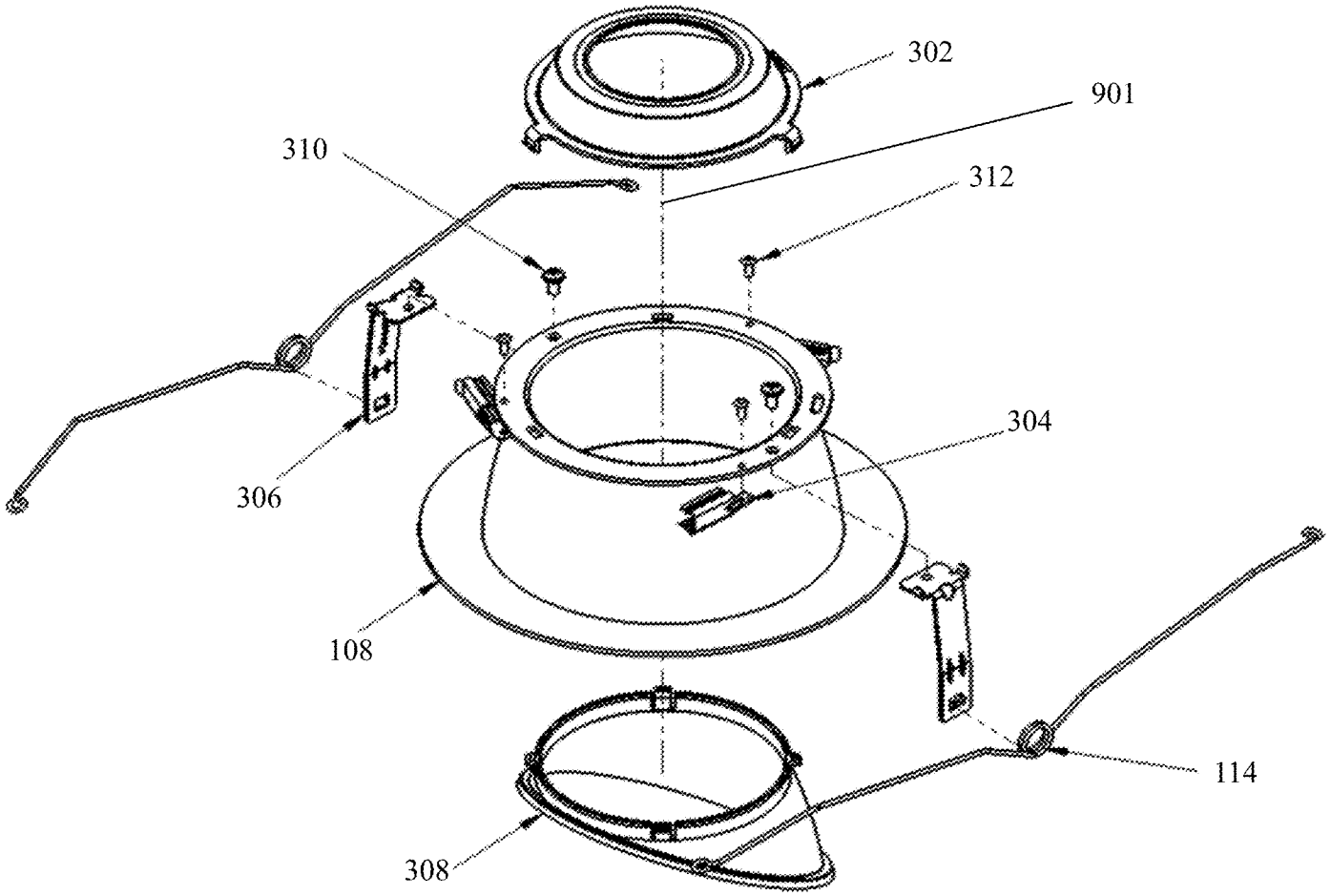
FIG. 10 illustrates an exploded view of the rotationally adjustable wall wash luminaire of FIG. 3, in accordance with example embodiments of the present disclosure.
Figure 11:
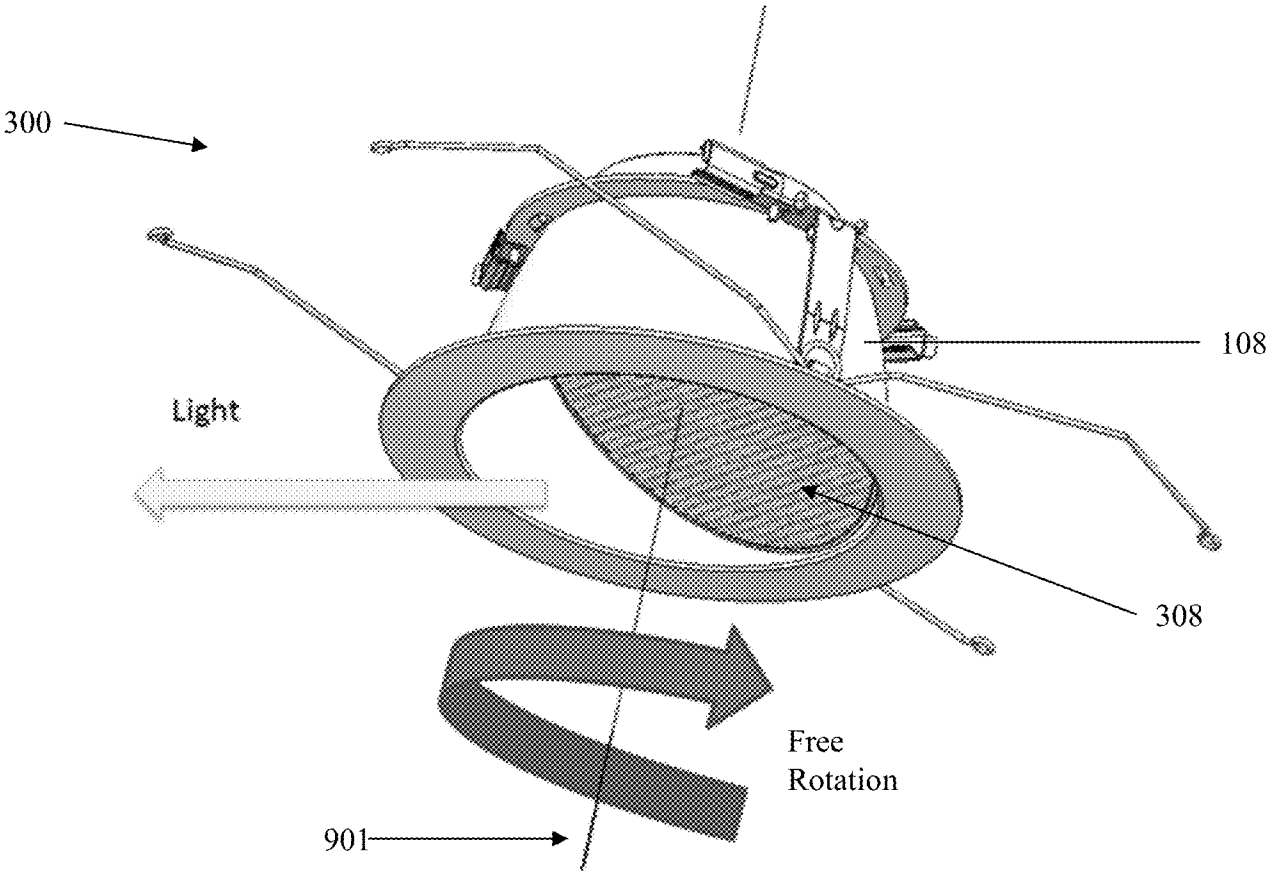
FIG. 11 illustrates another perspective view of the light fixture of the rotationally adjustable wall wash luminaire, in accordance with example embodiments of the present disclosure.

Turning to FIGS. 9 and 10, the light re-direction assembly 308 may be coupled to the trim 108 by positioning the top collar 606 of the reflector kicker 681 below the light exit opening 407 defined by the first bottom annular edge 401 of the trim 108 such that the light re-direction assembly 308 is disposed below and axially aligned with the trim 108. Then, the light re-direction assembly 308 is pushed upwards into the inner cavity 408 defined by the trim 108 through the light exit opening 407 till the coupling tabs 610 of the light re-direction assembly 308 engage the inner surface 405 (shown in FIG. 4) of the first body 402 of the trim 108. The coupling tabs 610 of the light re-direction assembly 308 that engage the inner surface 405 of the first body 402 of the trim 108 may bend or flex to allow the light re-direction assembly 308 to be further pushed into the inner cavity 408 (shown in FIG. 4) till the coupling tabs 610: (a) pass through the light receiving opening 406 defined by the first top annular edge 403 of the trim 108, and (b) engage the first top flange 409 of the trim 108. Then, the top reflector 302 may be coupled to the trim 108 by inserting the reflector tabs 512 of the top reflector 302 through the coupling slots 414 on the first top flange 409 of the trim 108. The top reflector 302 may be coupled to the trim 108 such that the second bottom flange 506 of the top reflector 302 is disposed on the coupling tabs 610 of the light re-direction assembly 308. In other words, the coupling tabs 610 of the light re-direction assembly 308 that rests on the first top flange 409 of the trim 108 may be disposed between the second bottom flange 506 of the top reflector 302 and the first top flange 409 of the trim 108 such that the light re-direction assembly 308 is slidingly rotatable 360° about the central axis 901 of the trim assembly 301 of the wall wash luminaire 300 as illustrated in FIG. 11. The central axis 901 of the trim assembly 301 (also, interchangeably referred to as the 'central axis of the trim') is an axis that passes through more than one of a center of the light exit opening 407 defined by the first bottom annular edge 401 of the trim 108, a center of the light receiving opening 406 defined by the first top annular edge 403 of the trim 108, a center of the top opening 511 defined by the second top flange 504 of the top reflector 302, and a center of the bottom opening 508 defined by the second bottom annular edge 501 of the top reflector 302.

In particular, the light re-direction assembly 308 can be freely rotated while the trim assembly 301 and/or the light fixture comprising the trim assembly 301 and the heat sink assembly (111 and 112) coupled thereto are attached to plaster ring 102 and disposed in the mounting surface, such as the ceiling. That is, the light re-direction assembly 308 of the present disclosure can be freely rotated to direct a light emitted from the wall wash luminaire 300 to any appropriate direction or any appropriate vertical wall that is adjacent to the wall wash luminaire and 360° about the central axis 901 without having to uninstall, rotate, and reinstall the light fixture of the wall wash luminaire as in conventional solutions. It is noted that the light re-direction assembly 308 can be manually rotated by the end user 360° about the central axis 901 both in the clockwise and counter clockwise direction while the trim assembly 301 remains installed in the ceiling without departing from a broader scope of the present disclosure. Further, during operation, light emitted from a light source of the wall wash luminaire may be re-directed by the reflector kicker 681 to a direction that is opposite the taller side, i.e., the first side 801 of the reflector kicker 681 as illustrated in FIG. 11.

Even though the present disclosure describes the light re-direction assembly 308 being coupled to the trim 108 by inserting the light re-direction assembly 308 into the inner cavity 408 of the trim 108 from below the trim 108, in other example embodiments, the light re-direction assembly 308 may be coupled to the trim 108 by inserting the light re-direction assembly 308 into the inner cavity 408 of the trim 108 from above the trim 108, i.e., through the light receiving opening 406 till the tabs 610 engage the first top flange 409 of the trim 108 without departing from a broader scope of the present disclosure.

Although the present disclosure is described with reference to example embodiments, it should be appreciated by those skilled in the art that various modifications are well within the scope of the present disclosure. From the foregoing, it will be appreciated that an embodiment of the present disclosure overcomes the limitations of the prior art. Those skilled in the art will appreciate that the present disclosure is not limited to any specifically discussed application and that the embodiments described herein are illustrative and not restrictive. From the description of the example embodiments, equivalents of the elements shown therein will suggest themselves to those skilled in the art, and ways of constructing other embodiments of the present disclosure will suggest themselves to practitioners of the art. Therefore, the scope of the present disclosure is not limited herein.

What is claimed is:

1. A wall wash luminaire comprising:

a trim assembly that comprises:

a trim comprising a first body extending from a first top annular edge defining a light receiving opening to a first bottom annular edge defining a light exit opening, the first body defining an inner cavity that extends from the light receiving opening to the light exit opening; and a first top flange extending radially outward from the first top annular edge, the first top flange comprising coupling slots formed therein;

a top reflector comprising a second body extending from a second top annular edge to a second bottom annular edge, the second bottom annular edge defining a bottom opening; a second bottom flange extending radially outward from the second bottom annular edge; and reflector tabs that extend out from an outer edge of the second bottom flange, wherein the reflector tabs are configured to engage the coupling slots of the trim to removably couple the top reflector to the trim; and a light re-direction assembly that comprises:

a reflector kicker; and a lens that is coupled to the reflector kicker, wherein the light re-direction assembly is coupled to the trim such that the light re-direction assembly is slidingly rotatable with respect to the trim and about a central axis of the trim assembly.

2. A wall wash luminaire comprising:

a trim assembly comprising:

a trim comprising a first body extending from a first top annular edge defining a light receiving opening to a first bottom annular edge defining a light exit opening, the first body defining an inner cavity that extends from the light receiving opening to the light exit opening; and a first top flange extending radially outward from the first top annular edge, the first top flange comprising coupling slots formed therein; and a light re-direction assembly comprising:

a reflector kicker; and a lens coupled to the reflector kicker, wherein the light re-direction assembly is coupled to the trim such that the light re-direction assembly is slidingly rotatable with respect to the trim and about a central axis of the trim assembly, and wherein the reflector kicker comprises:

a second body that extends from a second top annular edge to a second bottom annular edge and defines an internal cavity that extends therethrough;

a top collar that extends from the second top annular edge to a collar outer edge; and coupling tabs that extend out from the collar outer edge, wherein the coupling tabs of the reflector kicker are configured to engage the first top flange of the trim to removably couple the light re-direction assembly to the trim, and wherein when the light re-direction assembly is coupled to the trim, the second body of the reflector kicker is disposed in the inner cavity of the trim.

3. The wall wash luminaire of claim 1, wherein the reflector kicker comprises:

a third body that extends from a third top annular edge to a third bottom annular edge and defines an internal cavity that extends therethrough;

coupling tabs that are disposed adjacent the third top annular edge, wherein the reflector kicker is coupled to the trim by engaging the coupling tabs with the first top flange of the trim such that the third body of the reflector kicker is disposed in the inner cavity of the trim and the reflector kicker is slidingly rotatable about the central axis of the trim assembly; and a bottom coupling flange that defines an inner opening that is configured to receive and retain the lens therein, wherein the reflector kicker is coupled to the trim such that the coupling tabs of the reflector kicker are disposed between the second bottom flange of the top reflector and the first top flange of the trim.

4. The wall wash luminaire of claim 1, wherein the lens is fixedly coupled to the reflector kicker.

5. The wall wash luminaire of claim 1, wherein the lens is removably coupled to the reflector kicker.

6. The wall wash luminaire of claim 2, wherein a height of the second body measured from the second top annular edge to the second bottom annular edge tapers from a first side of the reflector kicker to a second side of the reflector kicker, the first side being opposite to the second side.

7. The wall wash luminaire of claim 1, wherein the reflector kicker comprises: a third body that extends from a third top annular edge to a third bottom annular edge and defines an internal cavity therethrough; and coupling tabs disposed adjacent the third top annular edge.

8. A wall wash luminaire comprising:

a trim assembly that comprises:

a trim comprising a first body extending from a first top annular edge defining a light receiving opening to a first bottom annular edge defining a light exit opening, the first body defining an inner cavity that extends from the light receiving opening to the light exit opening; and a first top flange extending radially outward from the first top annular edge, the first top flange comprising coupling slots formed therein; and a light re-direction assembly that comprises:

a reflector kicker; and a lens that is coupled to the reflector kicker, wherein the light re-direction assembly is configured to be coupled to a trim of the wall wash luminaire such that the light re-direction assembly is slidingly rotatable with respect to the trim and about a central axis of the trim, and wherein the reflector kicker comprises:

a second body that extends from a second top annular edge to a second bottom annular edge and defines an internal cavity that extends therethrough;

coupling tabs that are disposed adjacent the second top annular edge, wherein the reflector kicker is coupled to the trim by engaging the coupling tabs with the first top flange of the trim such that the second body of the reflector kicker is disposed in the inner cavity of the trim and the reflector kicker is slidingly rotatable about the central axis of the trim; and a bottom coupling flange that defines an inner opening that is configured to receive and retain the lens therein.

9. The wall wash luminaire of claim 8, further comprising:

a top reflector that comprises a bottom flange, and wherein the reflector kicker and the top reflector are configured to be coupled to the trim such that: (a) the coupling tabs of the reflector kicker are disposed between the bottom flange of the top reflector and the first top flange of the trim, and (b) a body of the reflector kicker is disposed in an inner cavity that is defined by a body of the trim.

10. The wall wash luminaire of claim 8, wherein the wall wash luminaire further comprises:

a top reflector that comprises:

a third body that extends from a third top annular edge to a third bottom annular edge, the third bottom edge defining a bottom opening;

a third bottom flange that extends radially outward from the third bottom annular edge; and reflector tabs that extend out from an outer edge of the third bottom flange, wherein the reflector tabs are configured to engage the coupling slots of the trim to removably couple the top reflector to the trim.

11. The wall wash luminaire of claim 8, wherein the reflector kicker comprises:

a top collar that extends from the second top annular edge to a collar outer edge; and wherein the coupling tabs extend out from the collar outer edge.

12. The wall wash luminaire of claim 8, wherein the lens is fixedly coupled to the reflector kicker.

13. The wall wash luminaire of claim 8, wherein the lens is removably coupled to the reflector kicker.

14. The wall wash luminaire of claim 8, wherein a height of the second body measured from the second top annular edge to the second bottom annular edge tapers from a first side of the reflector kicker to a second side of the reflector kicker, the first side being opposite to the second side.

15. The wall wash luminaire of claim 8, wherein the light re-direction assembly is slidingly rotatable with respect to the trim while the wall wash luminaire is installed in a mounting surface.

16. The wall wash luminaire of claim 11, wherein the top collar of the reflector kicker further comprises relief cuts that are formed therein, and wherein the relief cuts are formed adjacent to opposite sides of the coupling tabs.

* * * * *